US008413581B2

(12) United States Patent
Lassen

(10) Patent No.: US 8,413,581 B2
(45) Date of Patent: Apr. 9, 2013

(54) TRANSFER APPARATUS FOR PRINTING PLATE TRAYS AND METHOD OF HANDLING THE PRINTING PLATES

(75) Inventor: Bernd Lassen, Mönkeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 904 days.

(21) Appl. No.: 12/399,051

(22) Filed: Mar. 6, 2009

(65) Prior Publication Data

US 2009/0223399 A1 Sep. 10, 2009

(30) Foreign Application Priority Data

Mar. 6, 2008 (DE) ..... 10 2008 013 039
May 14, 2008 (DE) ..... 10 2008 023 601

(51) Int. Cl.
*B41L 47/14* (2006.01)
*B41F 27/12* (2006.01)

(52) U.S. Cl. ..... 101/477; 101/480

(58) Field of Classification Search ..... 101/477, 101/479, 480; 414/796.7, 416.3
See application file for complete search history.

(56) References Cited

U.S. PATENT DOCUMENTS 6,341,932 B1 1/2002 Otsuji
6,840,176 B1 1/2005 Armoni
7,152,531 B2 12/2006 Miyoshi
7,367,266 B2 5/2008 Takeda et al.
2004/0065221 A1 4/2004 Takeda
2005/0217524 A1* 10/2005 Miyoshi ..... 101/477
2005/0241517 A1 11/2005 Trilk et al.
2007/0227387 A1 10/2007 Takeda et al.

FOREIGN PATENT DOCUMENTS

DE 10 2004 020 693 A1 11/2005
JP 54039105 U 3/1979
JP 03080009 U 8/1991
JP 6032469 A 2/1994
JP 2005289522 A 10/2005
JP 2007271907 A 10/2007

OTHER PUBLICATIONS

German Search Report dated Nov. 3, 2008.

* cited by examiner

*Primary Examiner* — Leslie J Evanisko
(74) *Attorney, Agent, or Firm* — Laurence A. Greenberg; Werner H. Stemer; Ralph E. Locher

(57) ABSTRACT

An apparatus and a method is provided for handling printing plates which are provided in the form of a printing plate stack on at least one storage plane. If printing plates having a particularly large format are required to set images on them in an exposer, loading cassettes for a magazine of cassettes is at least problematic. Therefore, a tray is moved out of a storage device via an adjacent lifting device into the lower region of the storage device, and is fed there to a drawer which can be moved out of the storage device. If the tray is situated on the drawer, the latter can be moved by an operator in a second horizontal direction out of the handling apparatus, in particular out of the storage device. In this position, the tray can then be loaded in an ergonomically favorable manner.

19 Claims, 3 Drawing Sheets

TRANSFER APPARATUS FOR PRINTING PLATE TRAYS AND METHOD OF HANDLING THE PRINTING PLATES

CROSS-REFERENCE TO RELATED APPLICATIONS

This application claims the priority, under 35 U.S.C. §119, of German applications DE 10 2008 013 039.7, filed Mar. 6, 2008, and DE 10 2008 023 601.2, filed May 14, 2008; the prior applications are herewith incorporated by reference in their entirety.

BACKGROUND OF THE INVENTION

Field of the Invention

The present invention relates to an apparatus and a method for handling printing plates which are provided in the form of printing plate stacks on at least one storage plane.

In order to set images on printing plates which are used in a subsequent printing process, it is known to provide the printing plates in cassettes and to store a plurality of cassettes, for example having different printing plate formats, in a magazine, with the result that, in order to set images on a printing plate having a predefined format, a cassette can be removed from this magazine by what is known as a single cassette loader, that is to say a loading device, and a corresponding printing plate is separated from the cassette in the single cassette loader.

A corresponding apparatus for handling these printing plates which are provided in cassettes is known from published, non-prosecuted German patent application DE 10 2004 020 693 A1, corresponding to U.S. patent No. 20050241517.

Here, a plurality of cassettes are disposed above one another in a magazine and are stored in corresponding compartments. The compartments of the magazine can be moved vertically jointly, with the result that a desired cassette can be moved into the corresponding plane of the loading device, that is to say the single cassette loader, and is transferred in this plane to the single cassette loader, with the result that it can be opened in the single cassette loader and a printing plate can be separated.

The cassettes are loaded with printing plates outside the apparatus and are fed to the magazine via a corresponding transport carriage which is detached from the device. The opening, via which a new cassette can be fed to the magazine, and the opening, via which the single cassette loader is loaded with cassettes from the magazine, are provided here in one plane.

The printing plates are delivered to a printing plant in such a way that they first of all have to be inserted manually into a corresponding cassette. For this purpose, the cassettes have a louver which can be opened, with the result that plates can be introduced and which protects the plates against ambient light in the closed state.

If printing plates having a particularly large format are required to set images on them in an exposer, loading of the cassettes is at least problematic. If the cassettes are made available at the height, at which they are to be transferred into the magazine, correspondingly large printing plates of this type having a width of over 1.60 m can, for example, no longer be handled simply by operators. Even if they are held by two people, the printing plates sag and cannot be moved into the cassette easily.

However, if the cassettes are placed on the floor, although the cassettes can be loaded more easily with the printing plates, the problems with the sagging regions of the printing plate still exists, since the printing plate has to be raised over the outer edge of the cassette and, moreover, a correspondingly packed cassette has to be raised to the height of the loading opening of the magazine again. This is correspondingly difficult given a corresponding number of printing plates within one cassette.

SUMMARY OF THE INVENTION

It is accordingly an object of the invention to provide a transfer apparatus for printing plate trays and a method for handling printing plates which overcome the above-mentioned disadvantages of the prior art methods and devices of this general type, which makes the printing plates available for an imaging device and is configured accordingly in such a way that at least very large printing plate formats can also be used at least more simply and can be handled in such a way that they can be fed within an apparatus to an exposer for setting images.

With the foregoing and other objects in view there is provided, in accordance with the invention, a method for handling printing plates. The method includes the steps of: providing a multiplicity of printing plates as a printing plate stack on at least one storage plane; providing the storage plane in a first section of a device for handling the printing plates; preventing vertical movements of the storage plane in the first section; moving the storage plane in a first direction horizontally from the first section into a second section; moving the storage plane vertically in the second section into one of a first position and a second position; and performing one of: separating a printing plate of the printing plate stack in the first position and feeding the printing plate to an imaging apparatus for setting images on the printing plate; and moving the storage plane horizontally in a second direction out of a region of the first and second sections, the second direction lying substantially perpendicular with respect to the first direction, with the result that the storage plane can be accessed by an operator from three sides outside the second section.

According to the invention, a method of the generic type is provided for this purpose, in which method a multiplicity of printing plates are provided as a printing plate stack on at least one storage plane, and the storage plane or a plurality of the storage planes are provided in the vertical direction above one another in a first section of a device for handling the printing plates.

According to the invention, the first section can be a corresponding storage device for the storage planes, it practically being a magazine for the storage planes.

The storage planes are to be secured against vertical movements within the storage device, with the result that the storage planes can only be moved horizontally. Corresponding efforts to align the storage planes into a vertical defined position do not therefore have to be performed. All the storage planes also do not have to be moved vertically into the magazines at the same time, which is extremely complicated and difficult to carry out given particularly heavy and large printing plates.

In a further step, the storage planes are moved in a first direction horizontally from the first section, that is to say out of the storage device, into a second section, that is to say into a lifting device.

In the second section, that is to say in the lifting device, the storage planes are then moved vertically into a first or second position. In order to move only one storage plane with printing plates into a printing plate stack, correspondingly lower forces are necessary than for a multiplicity of storage planes.

If the storage plane is moved into a first position, a separating apparatus is assigned here, as is known from published, non-prosecuted German patent application DE 101 34 151 A1, corresponding to U.S. Pat. No. 6,779,793 which are herein incorporated by reference herein, with the result that printing plates can be separated correspondingly from the printing plate stack and can be forwarded to an imaging apparatus for setting images on the printing plates.

Furthermore, the storage plane can be moved into a second vertical position in the second section, that is to say in the lifting device, by lifting gear. The lifting device is configured at this position in such a way that the storage plane is moved out of the lifting device in a second direction out of this position, or it is configured in such a way that the storage plane is first of all moved into the storage device again and is moved out of the latter in the second horizontal position out of the storage device. This second horizontal direction lies substantially perpendicular with respect to the first horizontal direction, as a result of which the storage plane can be moved completely out of the lifting device or the storage device and can then be made substantially freely accessible for an operator from three sides.

According to the invention, the lifting device or the storage device is configured for this purpose in such a way that it contains a drawer which can receive the storage plane in the second vertical position and can move it out of the lifting device or the storage device.

In order to transfer a storage plane, the storage device and the lifting device adjoin one another in the first horizontal direction and the lifting device and/or the storage device have/has at least one transfer element for the complete transfer of a storage plane from the lifting device to the storage device and vice versa.

Furthermore, there is provision according to the invention for the second vertical position, that is to say the position in which the drawer is pulled out, to be that position which lies closest to the standing area of the entire apparatus or the standing area of the lifting device or storage device. The drawer is to be provided substantially in the lower region of the lifting device or storage device, with the result that an operator can access the drawer from the outside simply from above. Inserting new printing plates onto a storage plane which is guided to the outside together with the drawer is therefore facilitated, since no transport has to take place outside the apparatus for handling the printing plates in the vertical direction upward. In contrast, a printing plate can be taken from the beginning from a new stack of printing plates and placed onto a storage plane by two people. This can take place, for example, from the top to the bottom into the drawer.

In order to simplify the loading of the storage planes, there is provision for a storage plane to be provided in the manner of a tray. The latter is to be configured in such a way that there are no impeding lateral vertical boundaries. A transported printing plate cannot therefore come into contact with these vertical boundaries in an unintentional manner and have its surface damaged by the vertical boundaries.

In terms of the method, there is advantageously provision for the storage plane to be moved into the drawer by the lifting gear of the lifting device, in order for it to be possible for it to be moved out of the lifting device or the storage device together with the drawer.

In order to simplify loading of the storage plane even further, there is also provision for the drawer itself to have substantially no lateral vertical boundaries. In particular, there is provision here for the drawer to be made accessible without problems at least from the two lateral edges. To this extent, a boundary can also be provided at the front edge, in particular for the attachment of a handle for pulling out the drawer. However, the drawer can also be provided such that it can be moved overall automatically out of the lifting device. For this purpose, for example, pivoting or movement of the outer boundary of the drawer can be provided, which drawer is made available to close the access opening.

In order to accelerate the processing of printing plates by the apparatus for handling the printing plates, there is provision in terms of the method for a second storage plane to be moved by the lifting device to a first position, where it can feed the printing plates to the separating device, while at the same time a further storage plane is moved or has been moved out of the lifting device or the storage device in the region of the drawer. In this way, printing plates can be provided at the same time onto one storage plane, and a further storage plane can be used for separation.

Other features which are considered as characteristic for the invention are set forth in the appended claims.

Although the invention is illustrated and described herein as embodied in a transfer apparatus for printing plate trays and a method for handling printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
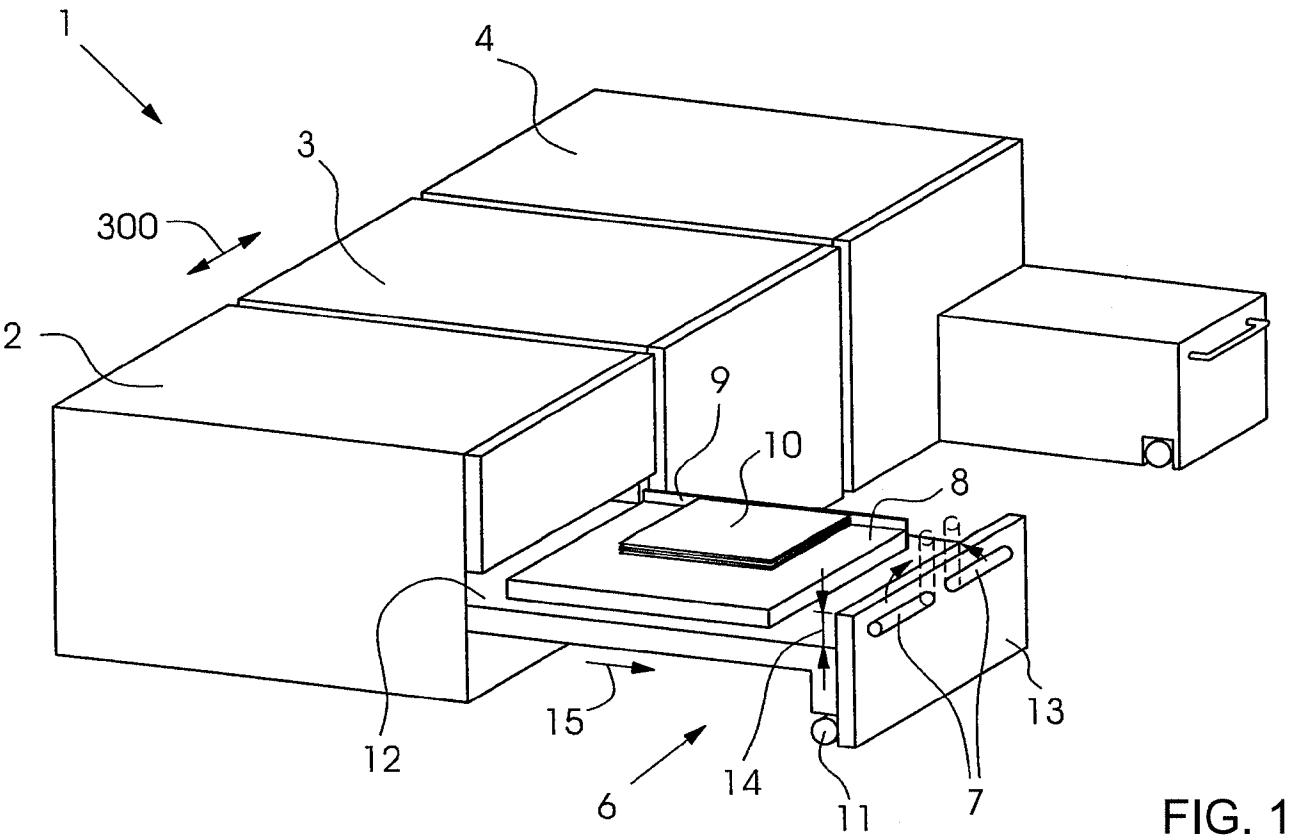
FIG. 1 is a diagrammatic, perspective view of a handling apparatus according to the invention.

Referring now to the figures of the drawing in detail and first, particularly, to FIG. 1 thereof, there is shown a handling apparatus 1 for printing plates 100, 200 which are to be fed from a storage device 2 to a non-illustrated plate exposer which adjoins the handling apparatus.

The printing plates 100 are provided in the form of a printing plate stack 10 on a tray 8.

The handling apparatus 1 contains the storage device 2 in the manner of a magazine, in which a plurality of the trays 8 having printing plate stacks 10 are provided stacked on one another.

The trays 8 can be moved out of the storage device 2 in a first direction 300 horizontally into a lifting device 3.

In the lifting device 3, the tray 8 can be moved in a vertical direction 304 by a lifting gear 307. A plurality of positions can thus be accessed in the lifting device 3.

In a first position in the lifting device 3, the printing plates 100 of the printing plate stack 10 can be fed to a separating device 4. The separation of the printing plates 100 takes place via non-illustrated separating elements which separate a printing plate 100 from the printing plate stack 10 of the tray 8.

Within the lifting device 3, the tray 8 can be moved vertically further into a second position by a lifting carriage 305 of the lifting gear, the second position corresponding to a bearing face 12 of a drawer 6. Here, the drawer 6 is situated in a lowermost region of the storage device 2.

The tray 8 is then moved again by the lifting device 3 in the direction of the first direction 300 into the storage device 2, more precisely onto the bearing face 12 of the drawer 6.

The drawer 6 contains rollers 11, a terminating face 13 which ends with the outer face of the handling apparatus 1, and pivotable handles 7.

If a tray 8 is situated on the bearing face 12 of the drawer 6, the handles 7 can be pivoted into a substantially vertical position and an operator 101 can move the entire drawer 6 by the rollers 11 out of the storage device 2 in a second direction 15.

If the drawer 6 has been moved completely out of the storage device 2, the tray 8 is freely accessible to an operator 101 substantially from three sides.

The drawer 6 has two side faces which do not have any vertical boundaries; a rear face, which is assigned to the handling apparatus 1 and is therefore not accessible, and a front face which has the terminating face 13. Here, the terminating face 13 is configured in such a way that it interacts with the spacing of the bearing face 12 from the standing area of the handling apparatus 1 in such a way that only one projecting face 14 of the terminating face 13 protrudes beyond the bearing face 12 of the drawer 6. Here, the projecting face 14 is so low that its height corresponds substantially to the overall height of the tray 8 and a printing plate stack 10 which is deposited on it.

As can be seen, the tray 8 can therefore be reached completely freely by an operator 101 from the two lateral faces of the drawer 6, and can be reached from the front side only in a manner which is slightly impeded by the projecting face 14. The handles 7 can be pivoted into horizontal positions again in the pulled out position of the drawer 6, with the result that they also do not stand in the way.

Figure 2:
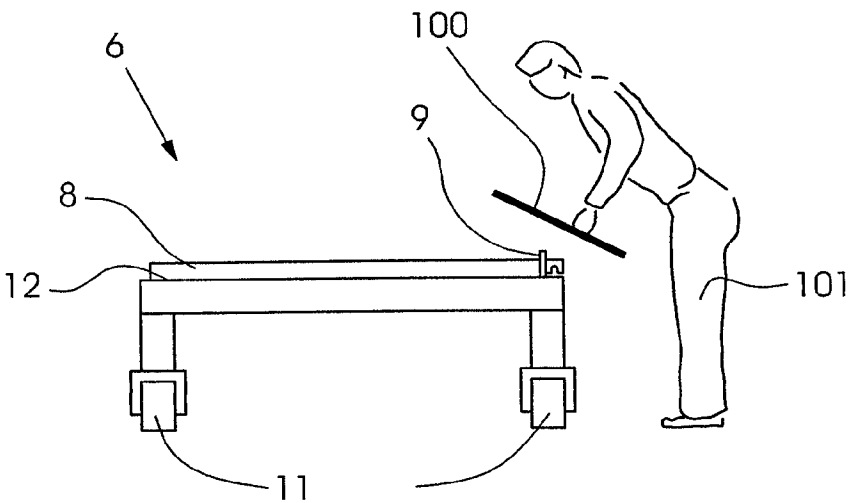
FIG. 2 is a diagrammatic, cross-sectional view of a drawer with a tray and an operator.

FIG. 2 shows an operator 101 during the loading of printing plates 100 on a tray 8, the format of which is so large that they can still be handled satisfactorily by a single operator 101.

The tray 8 rests on the bearing face 12 of the drawer 6. It contains a stop edge 9, on which the operator 101 can prealign the printing plates 100 slightly. Here, the operator 101 is situated on one of the side faces of the drawer 6, in particular in the region of the stop edge 9 of the tray 8.

Figure 3:
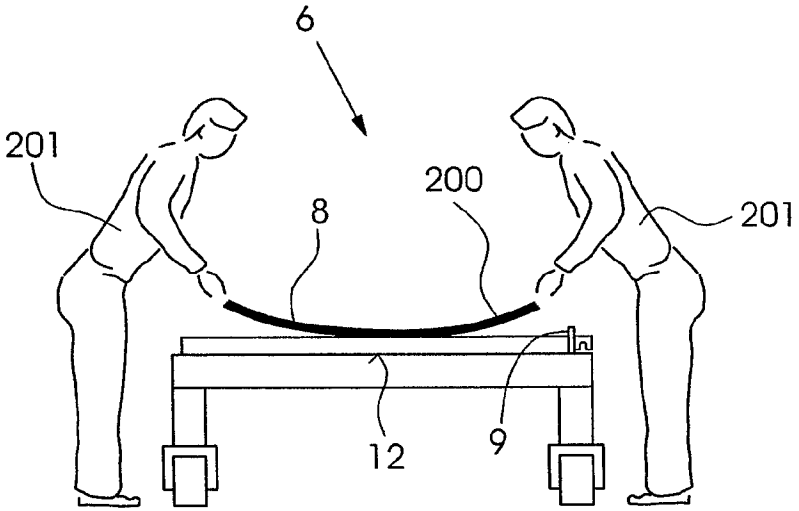
FIG. 3 is a diagrammatic, cross-sectional view of the drawer with two operators and large printing plates.

As in FIG. 2, FIG. 3 shows a cross section through the drawer 6, two operators 201 being shown here who in each case stand at the side faces of the drawer 6 in order to load a tray 8 on the bearing face 12 of the drawer 6 with large printing plates 200. It is shown here that the large printing plates 200 no longer form a rigid surface like the printing plate 100 as a result of their inherent weight, but rather sag centrally. They can no longer be handled by a single operator 201 and are therefore placed on the tray 8 by two people. The only impediments which act here against placing the printing plate 200 onto a corresponding printing plate stack 10 or directly onto the tray 8 are the stop edge 9 and the projecting face 14 which cannot be discerned here. However, both are selected to be so low that it does not require a great exertion by the operators 201 to overcome these obstacles and to load the large printing plates 200 in an ergonomically favorable way on account of the low tray loading height. In the selection of the stop edge 9 and the projecting face 14 shown here, no other height has to be overcome than that which is necessary in any case in order to deposit a printing plate 200 onto a printing plate stack. They are therefore not really obstacles.

Figure 4:
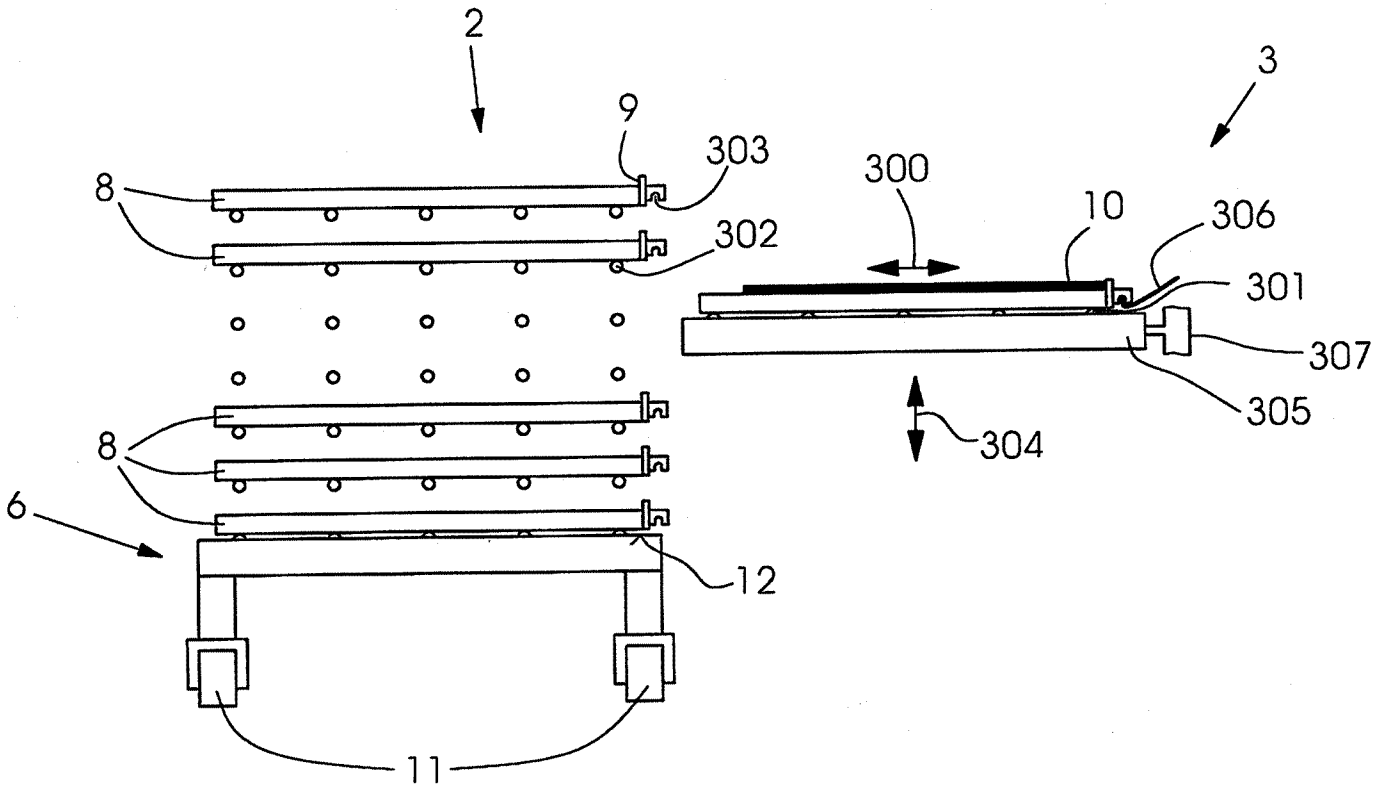
FIG. 4 is a diagrammatic, cross-sectional through the handling apparatus.

FIG. 4 shows a cross section through the handling apparatus 1 with the storage device 2 and the lifting device 3.

The storage device 2 and the lifting device 3 adjoin one another directly in the movement direction 300, with the result that trays 8 can be transported in a simple way from the storage device 2 into the lifting device 3.

As can be seen, a multiplicity of trays 8 can be provided in the storage device 2. Since the trays 8 are provided in the storage device 2 only in the form of a magazine in such a way that they cannot be moved vertically, a very compact overall shape can be selected which has the closest possible spacing between two trays 8 which lie above one another.

The trays 8 are mounted on roller elements 302 in the storage device 2, with the result that they can be moved on the roller elements 302 out of the storage device 2. For the engagement of a transfer element 306, a tray 8 has an engagement device 303, by way of which the transfer element can engage into the tray 8 and can move the latter in the horizontal direction 300. A suitable transfer element 306 having a hook shape is known, for example, from German patent DE 102 09 602 B4, corresponding to U.S. Pat. No. 6,863,487 which are hereby incorporated by reference herein.

A plurality of trays 8 which can store different formats of printing plates 100, 200 are situated in the storage device 2. The handling apparatus 1 is actuated by a non-illustrated control apparatus according to the predefined size of the printing plate 100, 200 which is to be used next. Depending on which printing plate format is to be fed next to an exposer, the lifting carriage 305 of the lifting device 3 is actuated in the vertical direction 304 in such a way that rolling elements 301 of the lifting carriage 305 are situated in the same plane as the rolling elements 302, on which the tray 8 having the desired printing plate format is situated. If the lifting carriage 305 is therefore situated in the desired position, the tray 8 is moved in the direction 300 horizontally onto the lifting carriage 305 by the non-illustrated transfer element.

Next, the lifting carriage 305 is moved into a position 1 (not shown explicitly here), in which it is accessible for the separating device 4, with the result that printing plates 100, 200 can be separated from the tray 8.

If further printing plates 100, 200 are to be provided on a tray 8, the lifting carriage 305 is moved by a non-illustrated control apparatus in the vertical direction 304 to the corresponding position, at which it can receive the tray 8 which is to be loaded. The tray 8 is moved onto the lifting carriage 305 again and subsequently the lifting carriage 305 is moved in a vertical direction 304 in such a way that it is situated at the same height as the bearing face 12 of the drawer 6 in the storage device 2. The tray 8 is then moved from the lifting carriage 305 onto the drawer 6 by a non-illustrated further transfer element. This movement takes place parallel to the first direction 300.

According to the invention, the tray 8 is therefore moved out of the storage device 2 via the adjacent lifting device 3 into the lower region of the storage device 2 and is fed there to the drawer 6 which can be moved out of the storage device 2.

If the tray 8 to be loaded is situated on the drawer 6, that is to say on the bearing face 12, the drawer 6 can be moved on the rollers 11 by an operator 101, 201 by the handles 7 in a second horizontal direction 15 which extends perpendicularly with respect to the first direction 300, out of the handling apparatus 1, in particular out of the storage device 2.

In this position, the tray 8 can then be loaded in an ergonomically favorable manner as described.

In an alternative embodiment of the invention, the drawer 6 can also be provided in the region of the lifting device 3 in such a way that it can access a tray 8 here, for example via cut-outs of the lifting carriage 305. The drawer 6 can then move a tray 8 out of the lifting device 3.

As a result of the described handling apparatus 1 for printing plates 100, 200, the lifting device 3 is to be configured only in such a way that only a single tray 8 which is occupied by a printing plate stack 10 has to be moved vertically in the direction 304. Vertical displacement of a plurality of trays 8 within the storage device 2 is not necessary. The lifting device 3 can therefore be of substantially simpler design.

Furthermore, an increase in the storage capacity of the storage device 2 can be realized simply, since only small spacings are necessary between the trays 8 of the storage device 2 and the vertical extent of the lifting device 3 therefore only has to be increased by a small amount in order to increase the capacity of the storage device 2.

Moreover, the region of the drawer 6 within the storage device 2 can be moved out in such a way that the lifting carriage 305 is again free of a tray 8. While the tray 8 is moved out on the drawer 6 and is loaded, the lifting carriage 305 can be moved by a control apparatus to a position, in which it can receive a tray 8 with a desired printing plate format and can make this printing plate format available with the tray 8 to the separating device 4, while the printing plates 100, 200 are still loaded by operators 101, 201. The down time of the handling apparatus 1 during loading with new printing plates 100, 200 can therefore be minimized.

The invention claimed is:

1. A method for handling printing plates, which comprises the steps of:

providing a multiplicity of printing plates as a printing plate stack on at least one storage plane being a tray substantially without continuous lateral vertical boundaries on three sides;

providing the storage plane in a first section of a device for handling the printing plates, the first section being a storage device;

preventing vertical movements of the storage plane in the first section;

moving the storage plane in a first direction horizontally from the first section into a second section with a transfer element for a complete transfer of a storage plane from the first section to the second section and vice versa, the second section being a lifting device having a lifting gear for moving the storage planes vertically at least into a first and a second position, and at least one of the lifting device and the storage device having a drawer for moving the storage plane horizontally out of one of the lifting device and the storage device;

moving the storage plane vertically in the second section into one of the first position and the second position;

moving the storage plane horizontally in a second direction out of a region of the first and second sections, the second direction lying substantially perpendicular with respect to the first direction, with the result that the storage plane can be accessed by an operator from three sides outside the second section.

2. The method according to claim 1, wherein the second position is a position lying closest to a depositing face of the second section and can be opened up by the storage plane.

3. The method according to claim 1, wherein the storage plane, before being moved out perpendicularly with respect to the first direction in the second position, is moved parallel to the first direction from the second section into the first section and is moved out of the first section in a second direction which lies perpendicular with respect to the first direction.

4. The method according to claim 1, which further comprises feeding the storage plane in the second position to the drawer, by means of which the storage plane is moved out of one of the first position and the second section.

5. The method according to claim 1, which further comprises:

moving the storage plane, being a first storage plane, horizontally out of one of the first section and the second section out of the second position and can be accessed by an operator from three sides;

moving a second storage plane out of the first section horizontally into the second section; and moving the second storage plane vertically into the first position and a printing plate of a printing plate stack of the second storage plane is separated.

6. An apparatus for handling printing plates, the apparatus comprising:

storage planes being trays substantially without continuous lateral vertical boundaries on three sides and each of said storage planes being configured for holding a stack of printing plates;

a storage device for said storage planes and defining a first section, said storage device configured such that said storage planes are secured against vertical movements; and a lifting device at least for moving said storage planes vertically and defining a second section, said storage device and said lifting device adjoining one another in a first horizontal direction, at least one of said lifting device and said storage device having a transfer element for a complete transfer of a storage plane from said lifting device to said storage device and vice versa, said lifting device having a lifting gear for moving said storage planes vertically at least into a first and a second position, and at least one of said lifting device and said storage device having a drawer for moving said storage plane horizontally out of one of said lifting device and said storage device, with a result that said storage plane can be reached in said drawer from three sides by an operator after being moved out.

7. The apparatus according to claim 6, wherein said drawer has substantially no lateral vertical boundaries.

8. The apparatus according to claim 6, wherein said drawer is disposed in a lower region of one of said lifting device and said storage device.

9. The apparatus according to claim 6, wherein said lifting device is set up such that said storage plane can be moved out of said storage device into said lifting device, while said drawer is provided such that said drawer can be moved out of one of said lifting device and said storage device into a loading position which can be reached by an operator.

10. The apparatus according to claim 6, wherein at least one said transfer element is provided for moving said storage plane from a store position into said lifting device and for moving said storage plane from the second position out of said lifting device into said storage device.

11. The apparatus according to claim 6, wherein said drawer is one drawer.

12. The apparatus according to claim 11, wherein said drawer is disposed in a lower region of one of said lifting device and said storage device.

13. The apparatus according to claim 6, wherein said drawers includes rollers, said rollers supporting said drawer outside of said first and second sections and facilitating movement of the drawers outside of said lifting device and said storage device.

14. The apparatus according to claim 13, wherein said rollers are configured for supporting said drawer by engaging a surface upon which the apparatus is mounted.

15. An apparatus for handling printing plates, the apparatus comprising:

storage planes being trays substantially without continuous lateral vertical boundaries on three sides and each of said storage planes being configured for holding a stack of printing plates;

a storage device for said storage planes and defining a first section, said storage device configured such that said storage planes are secured against vertical movements; and a lifting device at least for moving said storage planes vertically and defining a second section, said storage device and said lifting device adjoining one another in a first horizontal direction, at least one of said lifting device and said storage device having a transfer element for a complete transfer of a storage plane from said lifting device to said storage device and vice versa, said lifting device having a lifting gear for moving said storage planes vertically at least into a first and a second position, and said storage device having a drawer for moving said storage plane horizontally out of said storage device, with a result that said storage plane can be reached in said drawer from three sides by an operator after being moved out.

16. The apparatus according to claim 15, wherein said drawer is disposed in a lower region of said storage device.

17. The apparatus according to claim 15, wherein said drawer moves out of the apparatus.

18. The apparatus according to claim 15, wherein said drawer moves is a second horizontal direction perpendicular to said first horizontal direction.

19. The apparatus according to claim 15, wherein said drawers includes rollers, said rollers supporting said drawer outside of said first and second sections and facilitating movement of the drawers outside of said storage device.

* * * * *